US006398282B1

(12) United States Patent
Mononen

(10) Patent No.: US 6,398,282 B1
(45) Date of Patent: Jun. 4, 2002

(54) DEVICE FOR GATHERING LOGGING WASTE IN PARTICULAR

(75) Inventor: Sakari Mononen, Kontiolahti (FI)

(73) Assignee: Karelian Puu-ja Metalli Oy, Joensuu (FI)

( * ) Notice: Subject to any disclaimer, the term of this patent is extended or adjusted under 35 U.S.C. 154(b) by 0 days.

(21) Appl. No.: 09/403,508

(22) PCT Filed: Apr. 24, 1998

(86) PCT No.: PCT/FI98/00361

§ 371 (c)(1),
(2), (4) Date: Dec. 22, 1999

(87) PCT Pub. No.: WO98/49086

PCT Pub. Date: Nov. 5, 1998

(30) Foreign Application Priority Data

Apr. 25, 1997 (FI) ..... 971779

(51) Int. Cl.[7] ..... B66C 3/14

(52) U.S. Cl. ..... 294/106; 294/86.41; 294/88; 294/902

(58) Field of Search ..... 294/1.1, 67.22, 294/68.23, 86.4, 86.41, 88, 104, 106, 107, 902; 37/403, 405, 406, 449, 451–454, 903; 414/607, 722, 723, 732, 738, 739, 912; 901/28, 29, 39

(56) References Cited

U.S. PATENT DOCUMENTS 2,533,795 A * 12/1950 Hansen ..... 294/902 X
3,033,397 A * 5/1962 Busch ..... 294/106 X
3,038,620 A * 6/1962 Collin ..... 294/107 X
3,651,966 A * 3/1972 Willett ..... 294/86.41 X
3,782,567 A 1/1974 Likas et al.
3,802,731 A 4/1974 La Bounty ..... 294/88
3,920,137 A * 11/1975 McCain ..... 294/68.23 X
4,012,069 A * 3/1977 Carson ..... 294/106 X
4,017,114 A 4/1977 LaBounty ..... 294/88
4,353,424 A 10/1982 Schenck et al. ..... 172/438
4,401,407 A * 8/1983 Breckenridge ..... 294/106 X
4,413,945 A * 11/1983 LaBounty ..... 414/739
4,452,479 A 6/1984 Terai et al. ..... 294/88

* cited by examiner

*Primary Examiner*—Johnny D. Cherry
(74) *Attorney, Agent, or Firm*—Steinberg & Raskin, P.C.

(57) ABSTRACT

A device for gathering of logging waste in particular, by whose means logging waste is gathered from the ground by means of a dragging movement. The device that is substituted for a device that gathers waste by means of a grasping movement includes an arm (2) that has been connected with the arm of a crane (1) by the intermediate of an articulated joint (3), which arm (2) is pivoted by means of a power unit (4) around the articulated joint (3) against a backup plate (5) so as to incline the grab into a dragging position. The arms (6*b*) of the grab may also be provided with an arm (7), which, when it has been pivoted to the side (7*a*), prevents penetration of the grab arms (6*b*) below the ground surface and which, when they have been pivoted downwards (7*b*), permit compacting by means of the grab by means of a grab opening movement.

4 Claims, 2 Drawing Sheets

DEVICE FOR GATHERING LOGGING WASTE IN PARTICULAR

FIELD OF THE INVENTION

The invention concerns a device for making the gathering of logging waste quicker and for compacting of logging waste.

By means of the device, the gathering is carried out even from a thin layer by means of a dragging movement.

BACKGROUND OF THE INVENTION

In the prior art, logging waste is gathered by means of a freely suspended grab. Since the material is widely spread as a relatively thin layer, a number of grasping operations must be carried out by means of the grab by always lifting the load to a new location in order to add material to the grasp load.

When working takes place with the present-day equipment, drawbacks include the slow working when material is gathered into the grab, because it is necessary to lift heaps one onto the other so that a full load can be gathered for lifting onto the vehicle. Nor is it possible to achieve complete gathering of logging waste by means of the grasping method.

Since, by means of the prior-art grabs, it is almost not at all possible to affect the shape of the bundle, the directions of the logging waste in the grab remain highly different, and this has the consequence that the bundle in the grab remains loose because of the logging waste material placed crosswise. This results in a number of drawbacks; less material can be fitted in a vehicle load, and the further handling to the storage heap and from it to the chipper or to a vehicle for long-distance transportation is slower and, owing to the loose compacting, less economical. With the prior-art grabs, the bundle s already contained in the load cannot be compacted.

With respect to the prior art related to the present invention, reference is made to the patent publications U.S. Pat. No. 4,017,114, U.S. Pat. No. 4,353,424, and U.S. Pat. No. 3,802,731.

OBJECTS AND SUMMARY OF THE INVENTION

By means of the device in accordance with the present invention, a decisive improvement is provided in respect of the drawbacks mentioned above. In view of achieving this, the device in accordance with the invention includes an arm connected to an arm of a crane by an articulated joint, the arm being pivotable, by means of a power unit, around the articulated joint against a backup plate so as to incline the grab into a dragging position.

It can be considered to be the most important advantage of the invention that the working becomes essentially quicker as a thin layer of logging waste can be gathered, from the area of a number of grasping bundles, by means of one dragging movement by dragging along the ground surface to make a compact bundle in the grab. Further, the dragging movement has the effect that the branches and tree tops included in the logging waste are shifted into a substantially parallel oblong bundle. Good compacting of the bundle is also promoted by the fact that, being parallel, the material is compacted into a smaller volume than the space required if the material were lifted by the grab out of crosswise material of logging waste. Filling of the grab by means of a dragging movement also has the effect that the bundle becomes larger, because the tree tops and branches included in the bundle also attract material from a wider area than can be gathered by means of a grasping movement alone. Gathering by means of a dragging movement has also the effect that the logging waste can be recovered more completely. The working method can be compared with raking up.

An oblong compact bundle for the grab produced by means of a dragging movement has also the effect that more material can be fitted in the load, and when the load is unloaded to a storage heap, the logging waste is placed in the heap as parallel, so that it can be fed into the chipper more readily and more quickly, whereby the output of the chipper can be increased, or the waste can be loaded onto a vehicle for long-distance transportation, in which case the compactness of the bundles that are loaded has an essential significance for the economy of transportation, because the weight of logging waste is low in relation to its volume.

Further, the device can be provided with pivotal arms, which have two functions; when pivoted to the side, they operate during a dragging movement so as to keep the device at a correct level so that the arms of the device are not lowered below the ground level, and when the arms have been pivoted downwards, by their means, when the arms are inserted between bundles that have been loaded earlier, by means of a grab opening movement, the bundles can be compacted against the sides of the cargo space in order to provide space for the bundle that is being lowered from the grab. This compacting is possible In the case of bundles of oblong shape only, which bundles have been fitted as parallel and which can be produced by means of the device in accordance with the present invention and by means of the working method applied in connection with the device.

Thus, by means of the device in accordance with the invention, in a number of stages, compacting is achieved so as to make a loose material economically more favorable in view of loading and transportation.

In the following, the invention will be described in detail with reference to the accompanying drawing.

DETAILED DESCRIPTION OF THE INVENTION

Figure 1:
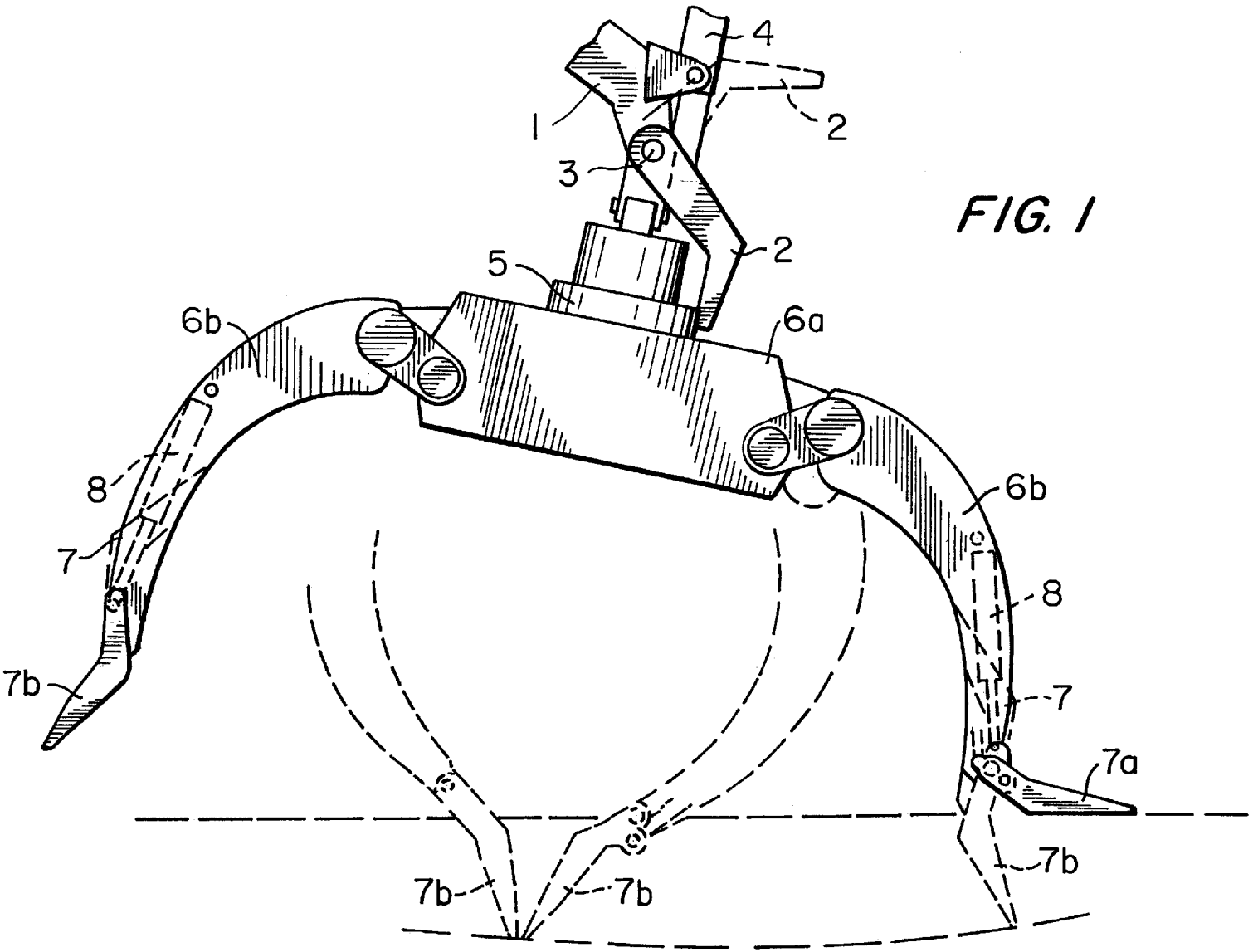
FIG. 1 is a side view of a device in accordance with the invention.

FIG. 1 shows a device, in which an arm 2 has been attached to the arm 1 of a crane by means of an articulated joint 3, which arm 2 is pivoted by means of a power unit 4 around the articulated joint 3, and by means of the end of the arm 2, a circular plate 5 is inclined, which plate has been attached to the frame 6*a* of the grab, which frame, when the arm 2 is pressed against the plate 5, inclines one side of the grab down while the opposite side remains up, which permits dragging of the grab and filling of the grab by means of a dragging movement. When the arm 2 is placed in an upper position, the grab is suspended freely during loading.

Figure 2:
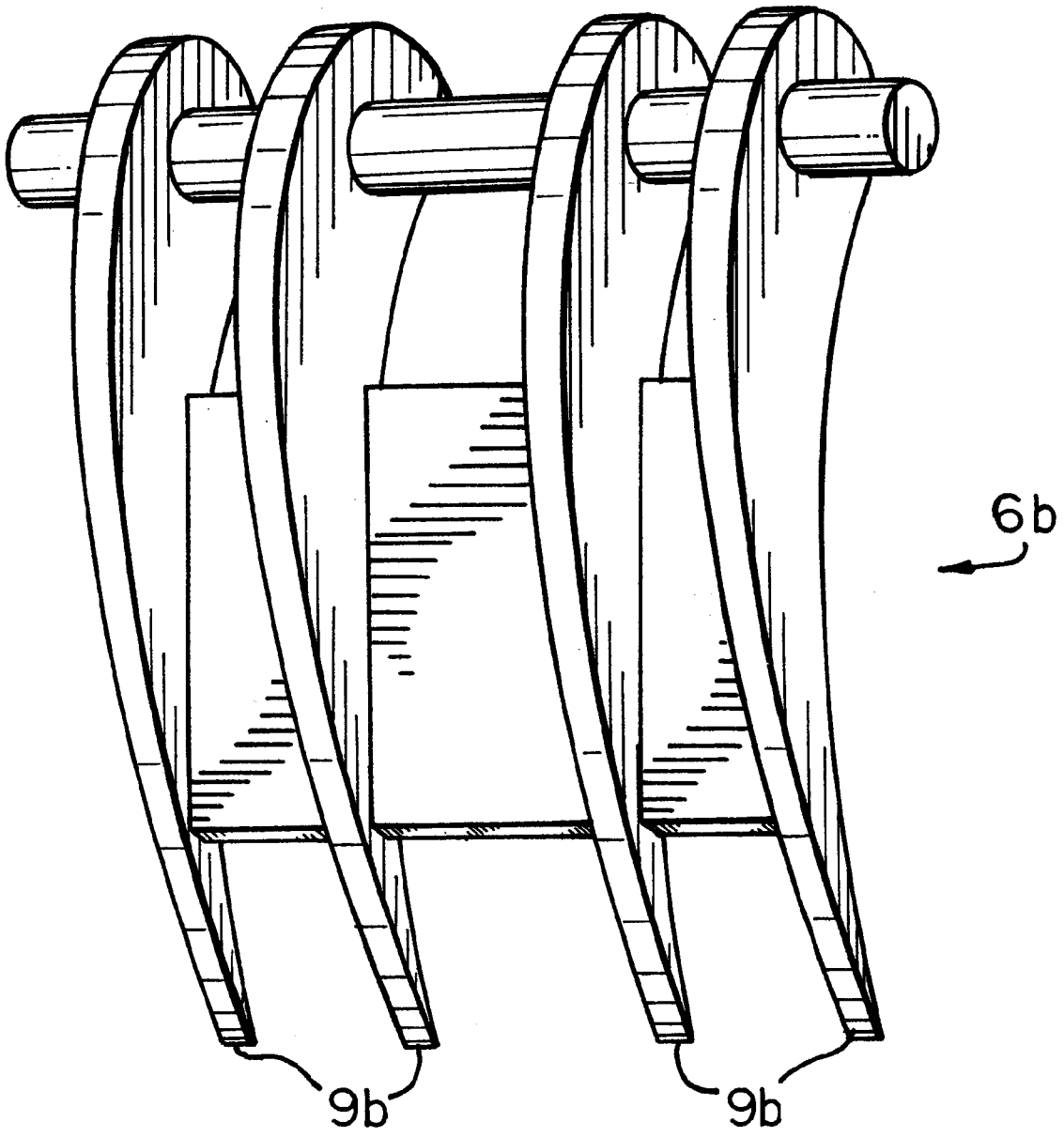
FIG. 2 is a perspective view of a grab arm which comprises part of the device in accordance with the invention.

FIG. 2 shows a perspective view of one of the arms 6*b* employed in the device according to the present invention. As shown the each grab arm 6*b* may include a plurality of teeth 9*b*.

There can be preferably 2 pairs or more than two pairs of arms 6*b* of the grab 6*a*. Further, the grab includes arms 7, of which there are preferably 2 pairs and which, when pivoted towards the side 7*a*, prevent penetration of the arms 6*b* of the grab below the ground surface, and, when the arms have been pivoted downwards 7*b*, they are used for compacting the load. The arm 7 is pivoted by means of a power unit 8, by whose means the arm 7 can also be placed in the upper position by pressing the arms 7 against the ground by means of the grab, in which case the arm 7 is pivoted beyond the zero angle. The returning can take place by means of a spring.

When the arms 6*b* of the grab are pivoted outwards, the arms 6*b* and the arms 7 press the bundles of logging waste placed outside into compact bundles so that the material present in the grab can fall down into the space thus formed.

The function of the arms 7 is, in the position 7*b*, to be able to penetrate between the bundles and to increase the length of the arms 6*b* and to promote the keeping of the material in its position during the compacting stage.

What is claimed is:

1. A device for gathering of logging waste in particular, comprising:

a grab frame (6*a*) for coupling to an arm of a crane, grab arms (6*b*) provided with a number of teeth, each of said grab arms (6*b*) coupled to said grab frame (6*a*), a power unit for pivoting the grab arms (6*b*), an arm (2) for connecting to an arm of a crane by an articulated joint (3), wherein said arm (2) is structured and arranged to be pivoted by means of a power unit (4) around the articulated joint (3) against a backup plate (5) so as to incline the device into a dragging position, a pair of arms (7), each arm (7) connected to an end of one of said grab arms (6*b*), each one of said arms (7) having a first position (7*a*) for preventing penetration of the grab arms (6*b*) below a ground surface and a second position (7*b*) for permitting compacting of a load by said grab arms (6*b*).

2. A device for gathering logging waste for use with a crane having an arm, comprising:

a frame for coupling to an arm of a crane;

a pair of grab arms having terminate ends pivotally coupled to said frame;

an arm for pivotally coupling to the arm of the crane;

a power unit for pivoting said grab arms and said arm for pivotally coupling to the arm of the crane;

a backup plate, wherein said arm for pivotally coupling to the arm of the crane is structured and arranged to pivot against said backup plate to incline the device into a dragging position;

a pair of arms, each one of said pair of arms pivotally coupled to an end of one of said pair of grab arms, each one of said pair of arms pivotally coupled to an end of one of said grab arms having a first position in which said pair of grab arms are prevented from penetrating the ground surface and a second position for permitting compacting of a load by said grab arms.

3. The device as in claim 2, further comprising a power unit for pivoting each one of said pair of arms pivotally coupled to an end of one of said grab arms.

4. The device as in claim 2, wherein said arm for pivotally coupling to the arm of the crane is coupled to the arm of the crane by an articulated joint.

* * * * *